US005820207A

United States Patent [19]

Wang

[11] Patent Number: 5,820,207

[45] Date of Patent: Oct. 13, 1998

[54] NURSERY CHAIR

[75] Inventor: Hsiu-Yen Wang, Tainan Hsien, Taiwan

[73] Assignee: Tsen Gei Enterprise Co., Ltd., Tainan Hsien, Taiwan

[21] Appl. No.: 947,391

[22] Filed: Oct. 8, 1997

[51] Int. Cl.[6] ..... A47C 4/00; A47D 1/02

[52] U.S. Cl. ..... 297/27; 297/19; 297/148; 297/151; 297/135

[58] Field of Search ..... 297/27, 16.2, 19, 297/135, 148, 151

[56] References Cited

U.S. PATENT DOCUMENTS

| | | | |
|---|---|---|---|
| 2,816,598 | 12/1957 | Shone | 297/151 X |
| 2,845,993 | 8/1958 | Eads et al. | 297/148 X |
| 3,425,743 | 2/1969 | Peterson | 297/19 |
| 3,425,744 | 2/1969 | Spector et al. | 297/19 |
| 4,072,341 | 2/1978 | Kurz | 297/27 |
| 4,421,358 | 12/1983 | Lehnen | 297/27 X |

FOREIGN PATENT DOCUMENTS

| | | | |
|---|---|---|---|
| 387764 | 9/1990 | European Pat. Off. | 297/19 |
| 954606 | 4/1964 | United Kingdom | 297/27 |

*Primary Examiner*—Laurie K. Cranmer
*Assistant Examiner*—Rodney B. White
*Attorney, Agent, or Firm*—Pro-Techtor International Services

[57] ABSTRACT

A nursery chair includes a front and a rear support frame, a seat and a table. A collapsing device is provided between the front and the rear support frame for them to spread and collapse. A inclining device is provided to change the angle of the seat. Further, an securing device for the table is provided to keep the table secured, not to swing up or down at random.

10 Claims, 17 Drawing Sheets

NURSERY CHAIR

BACKGROUND OF THE INVENTION

This invention relates to a nursery chair, particularly to one convenient and safe to use.

A conventional nursery chair shown in FIG. 1 includes a front and a rear support frame 10 and 11, a seat 12 fixed on the front and the rear support frame, and a table 13 disposed in front of the seat. However, this conventional nursery chair has the following disadvantages.

1. Uneasy to put away for storing: as the front and the rear support frame 10, 11 are immovable, and rather of a large size, taking a large dimensions.

2. Uncomfortable: as the seat 13 is directly fixed with the front and the rear support frame 10, 11, impossible to adjust the angle of the seat to suit to a small child sitting thereon.

3. Dangerous: the table 13 is commonly pivotally combined with the seat 12, possible to be swung up to let a small child moved out of the seat 12, and possible to be swung up by a small child very active to let hot drink or the like flow down on the child.

SUMMARY OF THE INVENTION

The purpose of the invention is to offer a nursery chair with effective use and considerable safety.

One feature of the invention is a collapsible device for the front and the rear support frame to make it collapsible to a small dimensions for convenience of storing and transporting.

Another feature of the invention is an inclining device for the seat to let the angle of the seat adjustable.

One more feature of the invention is an adjusting device for the table to be adjusted in its position back and forth, to keep the table horizontal securely and be swung up to let a child taken out.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
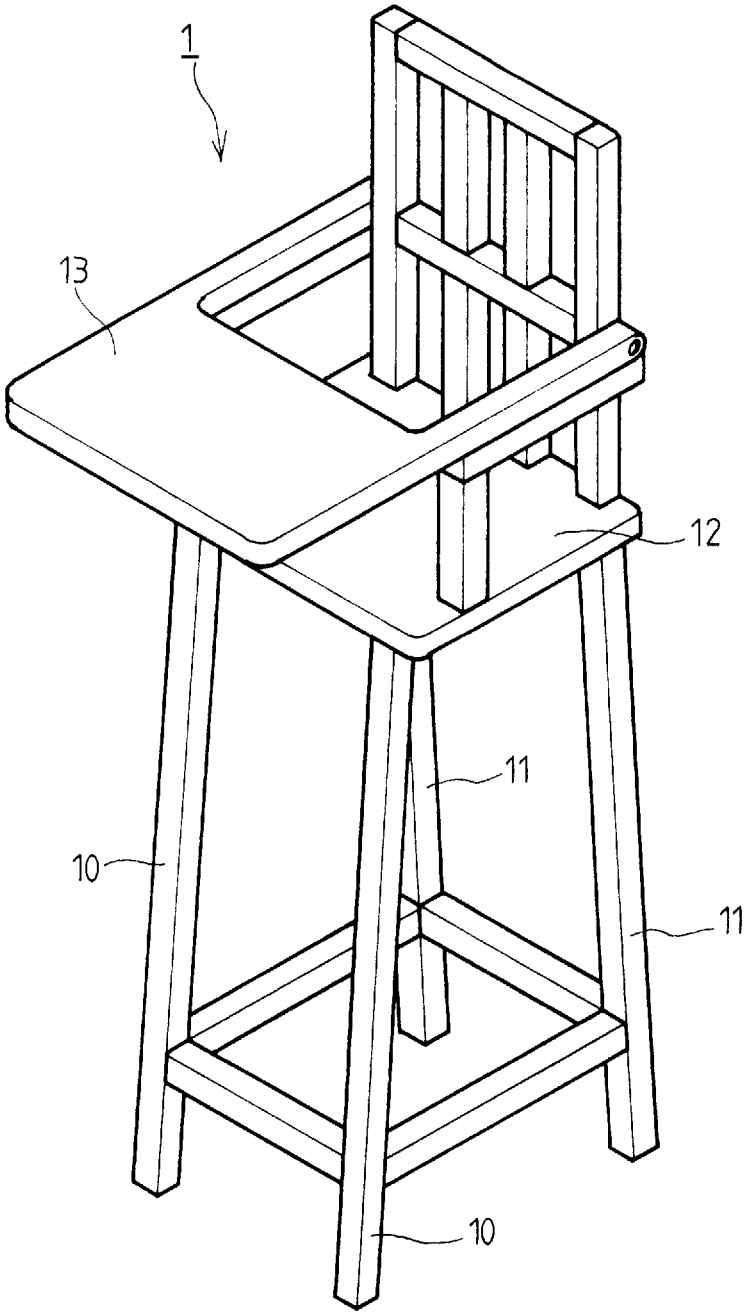
FIG.1 (PRIOR ART)
FIG. 1 is a perspective view of a conventional nursery chair.
Figure 2:
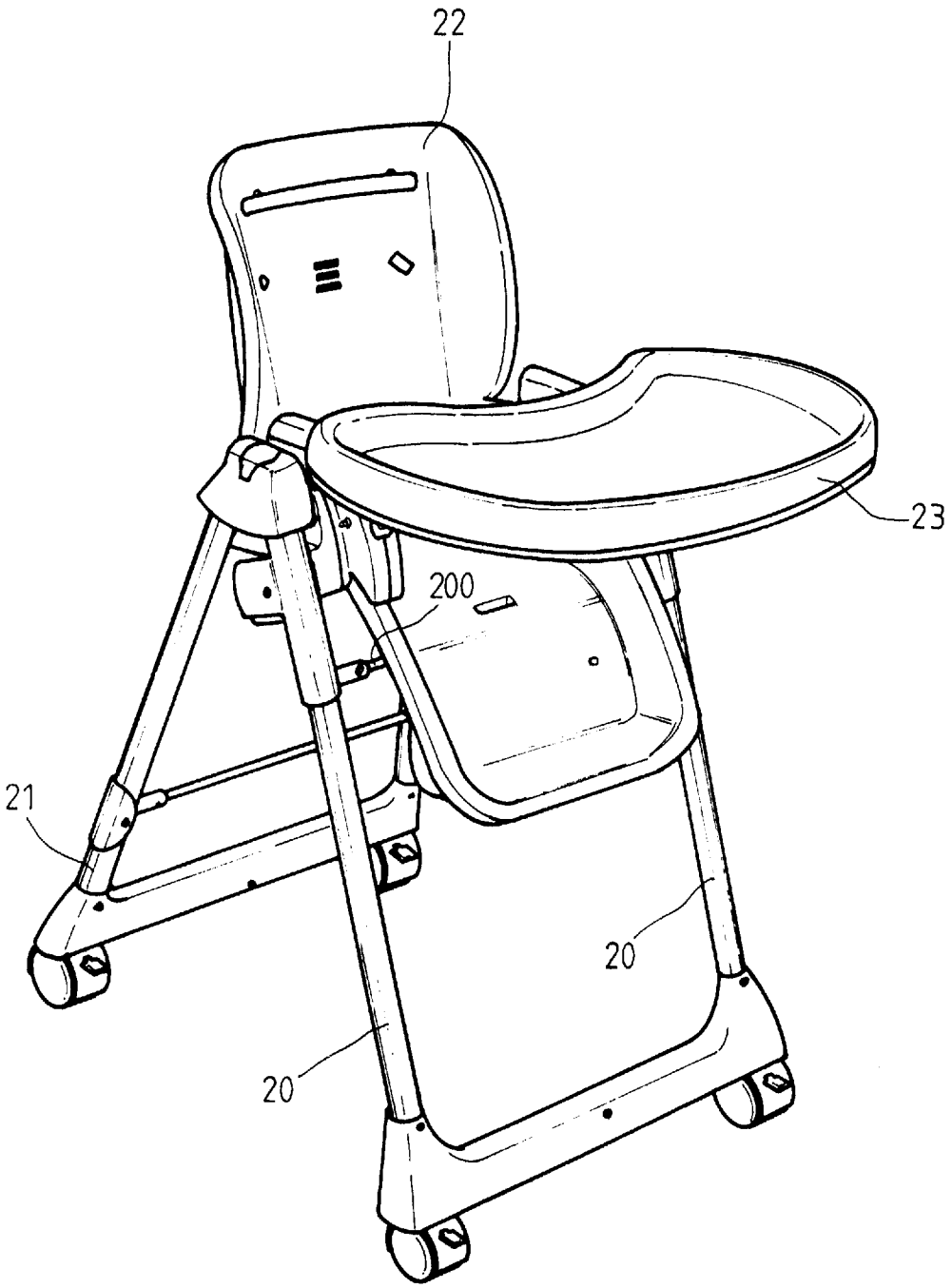
FIG. 2 is a perspective view of a nursery chair in the present invention.
Figure 3:
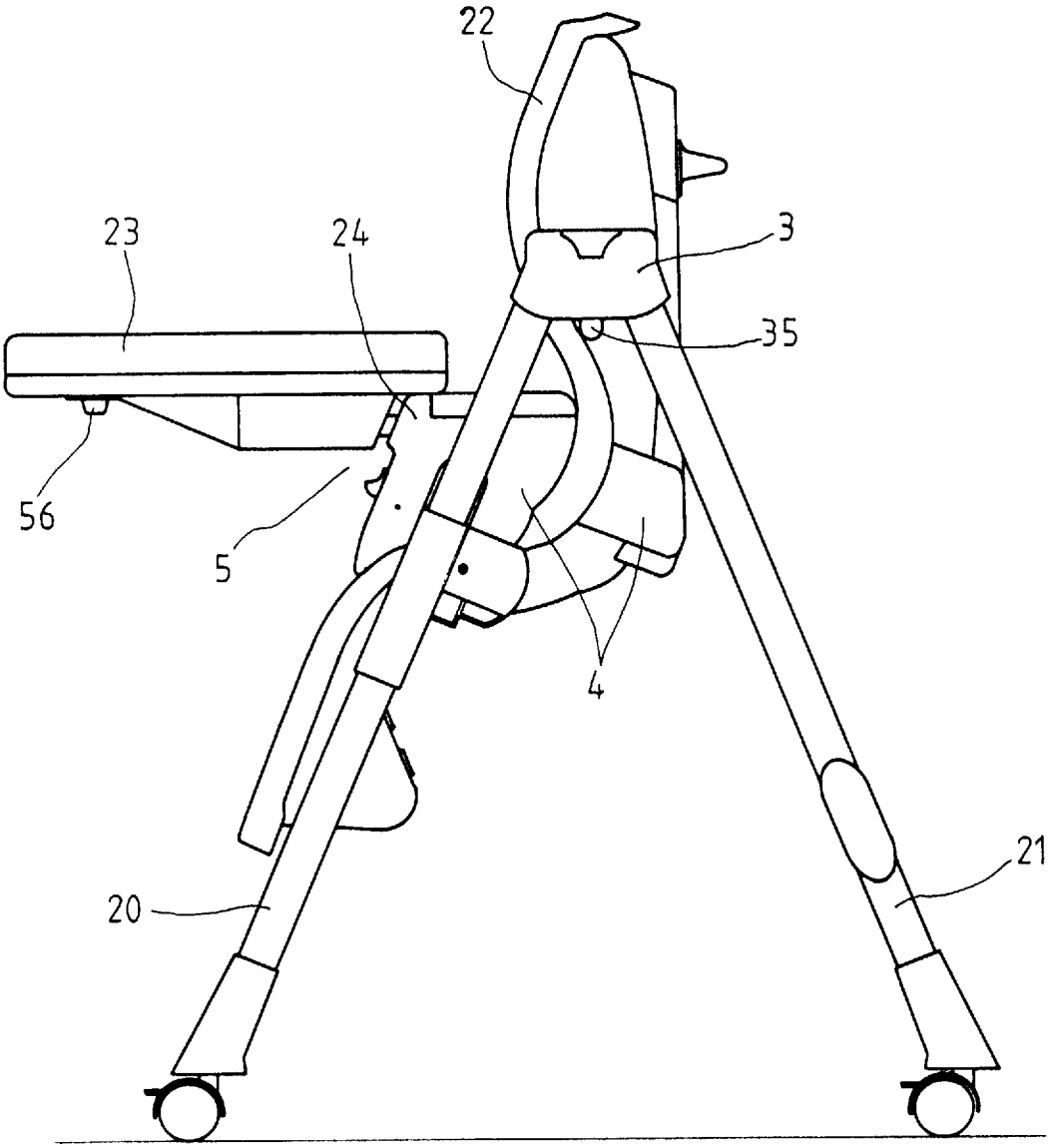
FIG. 3 is a side view of the nursery chair in the present invention.
Figure 4:
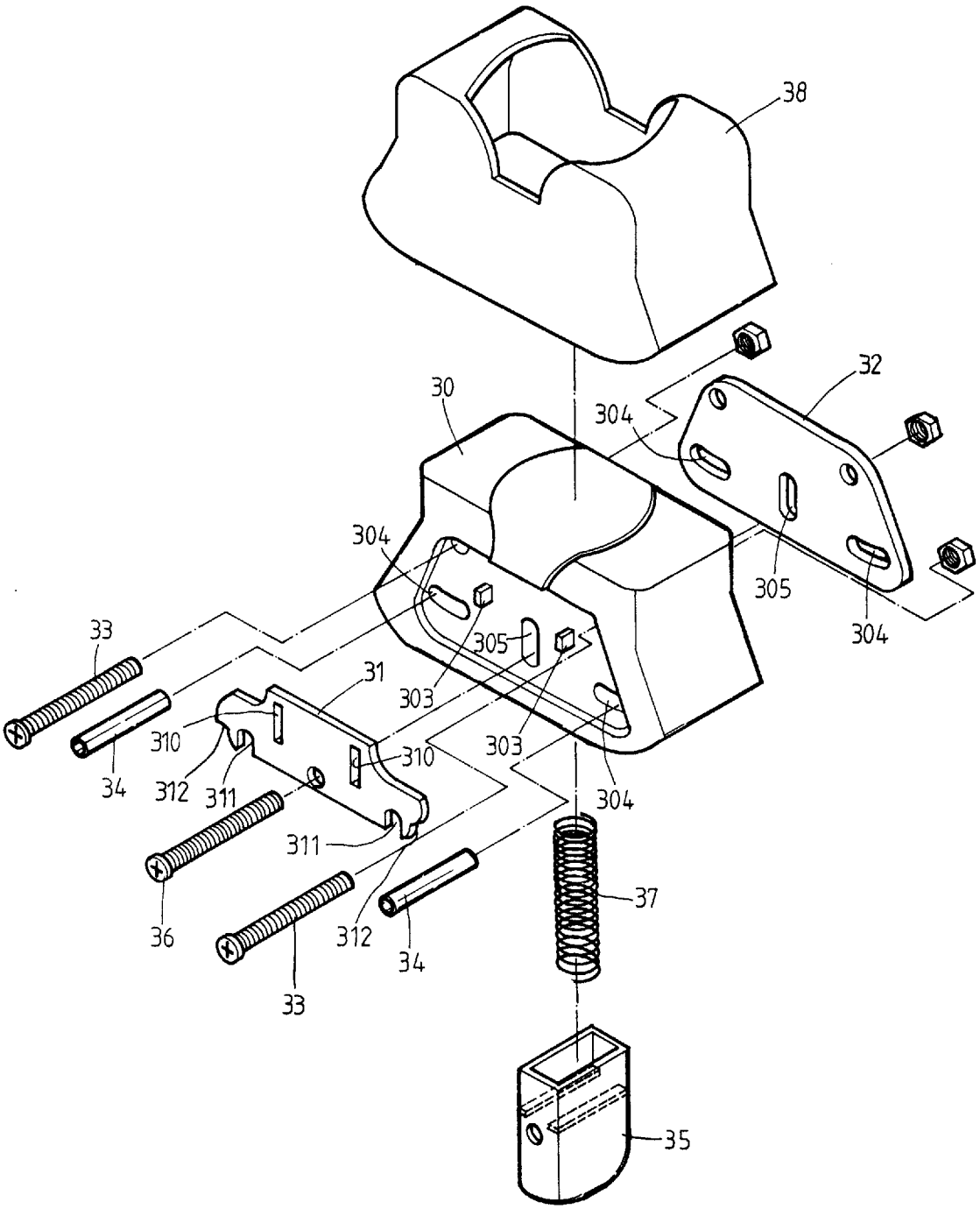
FIG. 4 is an exploded perspective view of a collapsing device in the present invention.

A preferred embodiment of a nursery chair in the present invention, as shown in FIGS. 2 and 3, includes a front support frame 20, a rear support frame 21, a seat 22 combined with the front support frame 20, a table 23 disposed in front of the seat 22, a collapsing device 3 for collapsing the front and the rear support frame 20 and 21, an inclining device 4 for inclining the seat 22 in one of many angles, and a securing device 5 for the table 23 for keeping it securely, as main components.

The collapsing device 3 for the front and the rear support frame 20 and 21 includes a connect base 30, a movable plate 31, a stationary plate 32 plate 31, three screws 33, 33, 36, two latch rods 34, 34. a slidable member 35, a spring 37 and a housing 38.

The connect base 30 has a front room 300, a rear room 301 respectively for an upper end of the front and the rear support frame 20 and 21 to extend therein. The connect base 30 further has two projections 303 spaced apart on the left side.

The movable plate 31 is located at a left side of the connect base 30, and the stationary plate 32 is located at a right side of the connect base 30. The movable plate 31 has two vertical slots 310, 310 spaced apart for the projections 303, 303 of the connect base 30 to fit and move up and down therein, and two notches in two ends for screws 33, 33 to pass through and also through the front and the rear rooms 300, 30. which are combined with the stationary plate 32. The two latch rods 34, 34 pass through under the upper end of the front and the rear support frame 20 and 21, through two 1lateral slots 304, 304 provided in the front and the rear room 300, 301 and the stationary plate 32 so that the front and the rear support frame 20 and 21 may be spread and collapsed by means of the two latch rods 34, 34 moving in the slots 304, 304. In addition, in order to limit moving distance of the front and the rear support frames 20 and 21 in spreading and collapsing, the movable plate 31 has notches 311 and 312 for the latch rods 34, 34 to engage with.

The slidable member 35 is disposed in the intermediate room 302 of the connect base 30, positioned by by a screw 36, which also passes through the movable plate 31, a vertical slot 305 in the intermediate room 302 and the stationary plate 32, therefore, the slidable member 35 may move up and down within the length of the slot 305, moving the movable plate 31 up and down synchronously. Further, the spring 37 is deposited in the intermediate room 302, with its lower end fitted in the slidable member 35 so as to push down the slidable member 35 for keeping the latch rods 34, 34 always engage the notches 311, 311 or 312, 312. Then the housing 38 surrounds the movable plate 31, the stationary plate 32 and the connect base 30 to protect them.

Figure 5:
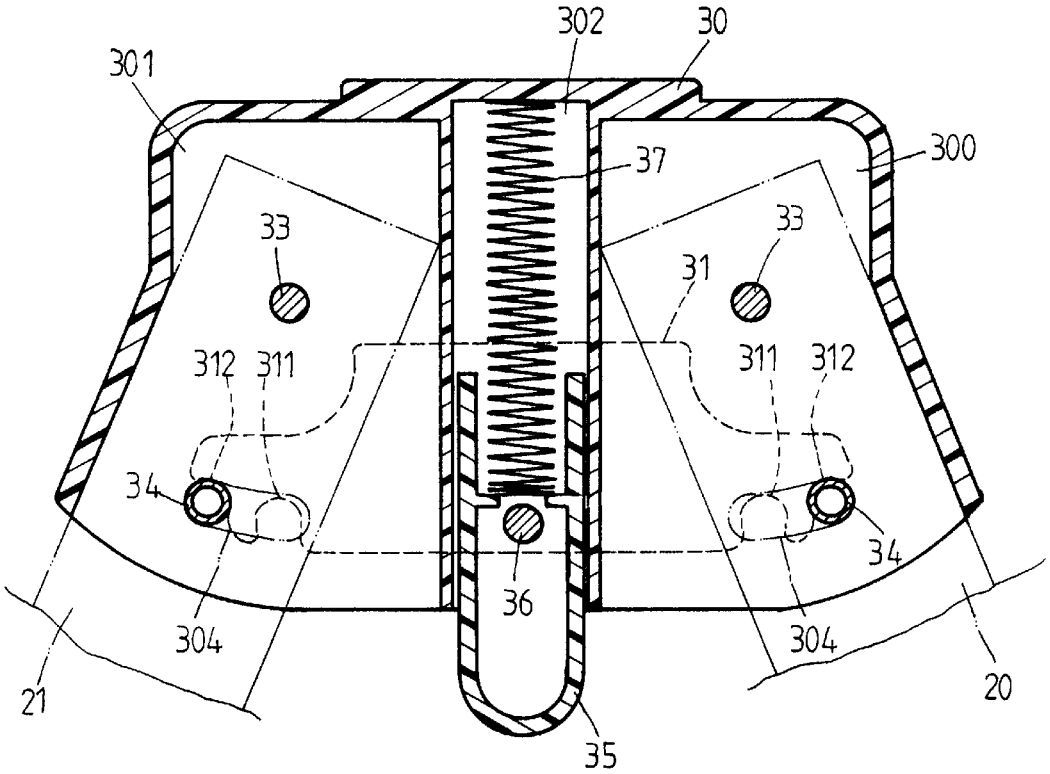
FIG. 5 is a side cross-sectional view of the collapsing device in the present invention.
Figure 6:
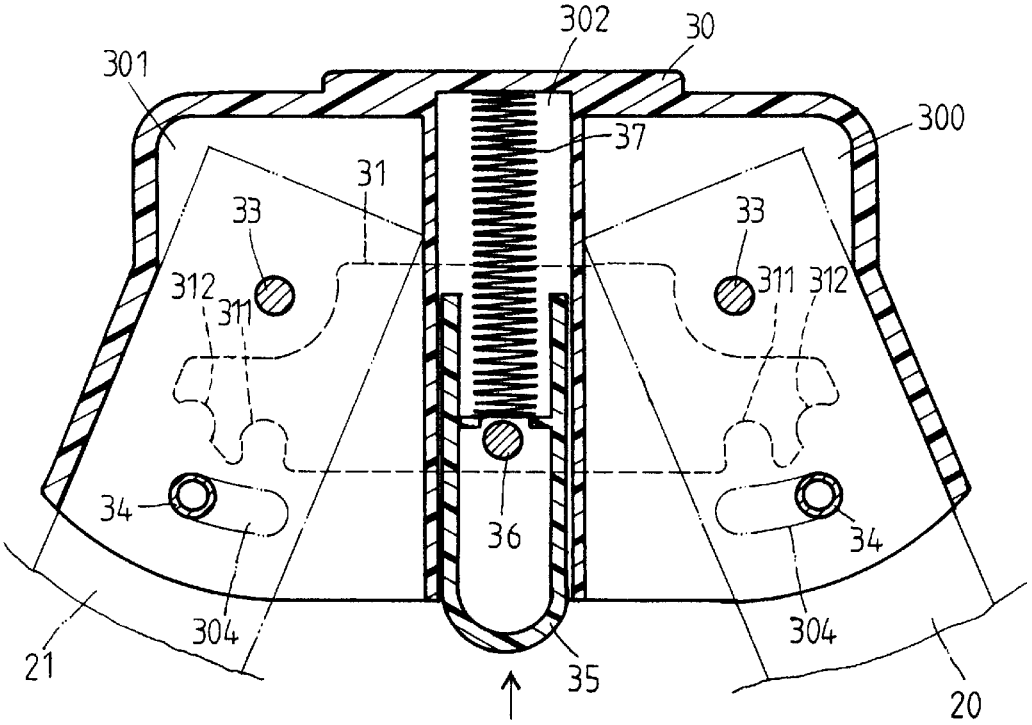
FIG. 6 is a side cross-sectional view of the collapsing device being used in the present invention.
Figure 7:
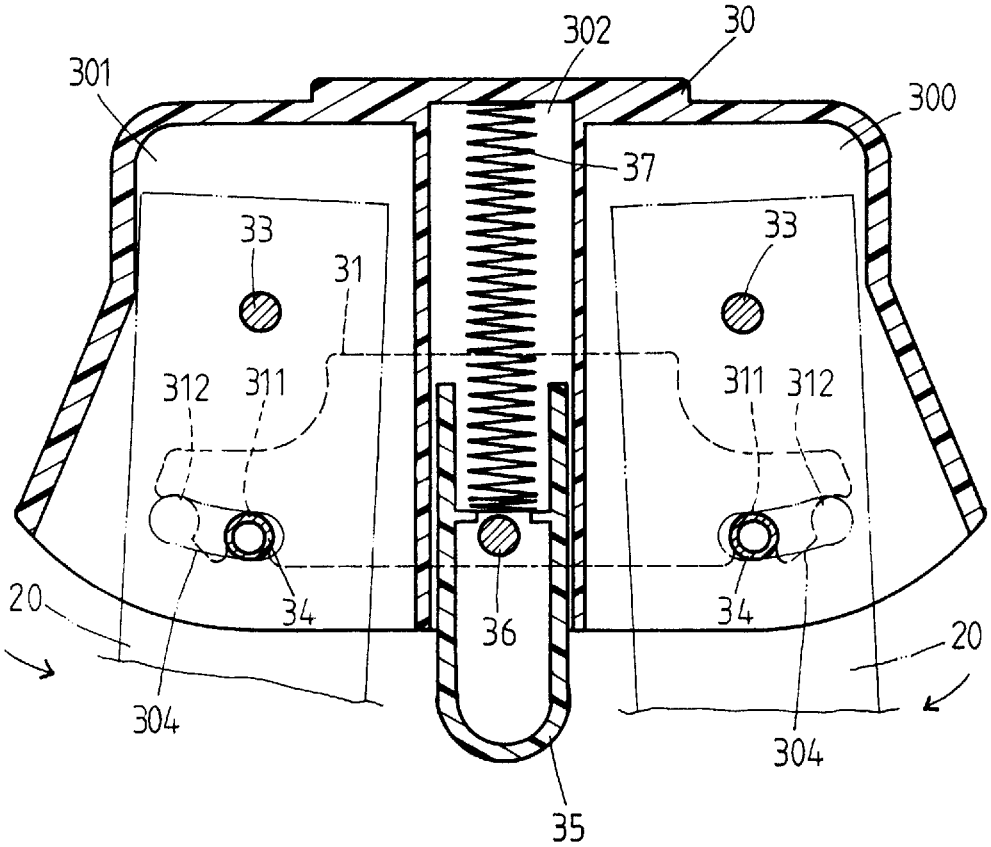
FIG. 7 is another side cross-sectional view of the collapsing device used in another way in the present invention.

FIG. 5 show how the collapsing device 3 is combined with the front and the rear support frame 20 and 21. When the front and the rear support frame 20 and 21 are needed to be collapsed from a spread position shown in FIG. 5, the slidable member 35 is Pushed up to let the movable plate 31 move up at the same time as shown in FIG. 6, disengaging the latch rods 34, 34 from the notches 312, 312 of the movable plate 31. Then the front and the rear support frames 20 and 21. are pushed inward as shown in FIG. 7, with the slidable member 35 released to let the movable plate 31 move down, with the latch rods 34, 34 engaging the notches 311, and with the front and the rear support frames 20 and 21 moved in a collapsed position. If the front and the rear support frames 20 and 21 are to be spread from the collapsed position shown in FIG. 7 to the spread position shown in FIG. 5, the reversal process described just above is performed, letting the latch rods 34, 34 engage the notches 312, 312.

Figure 8:
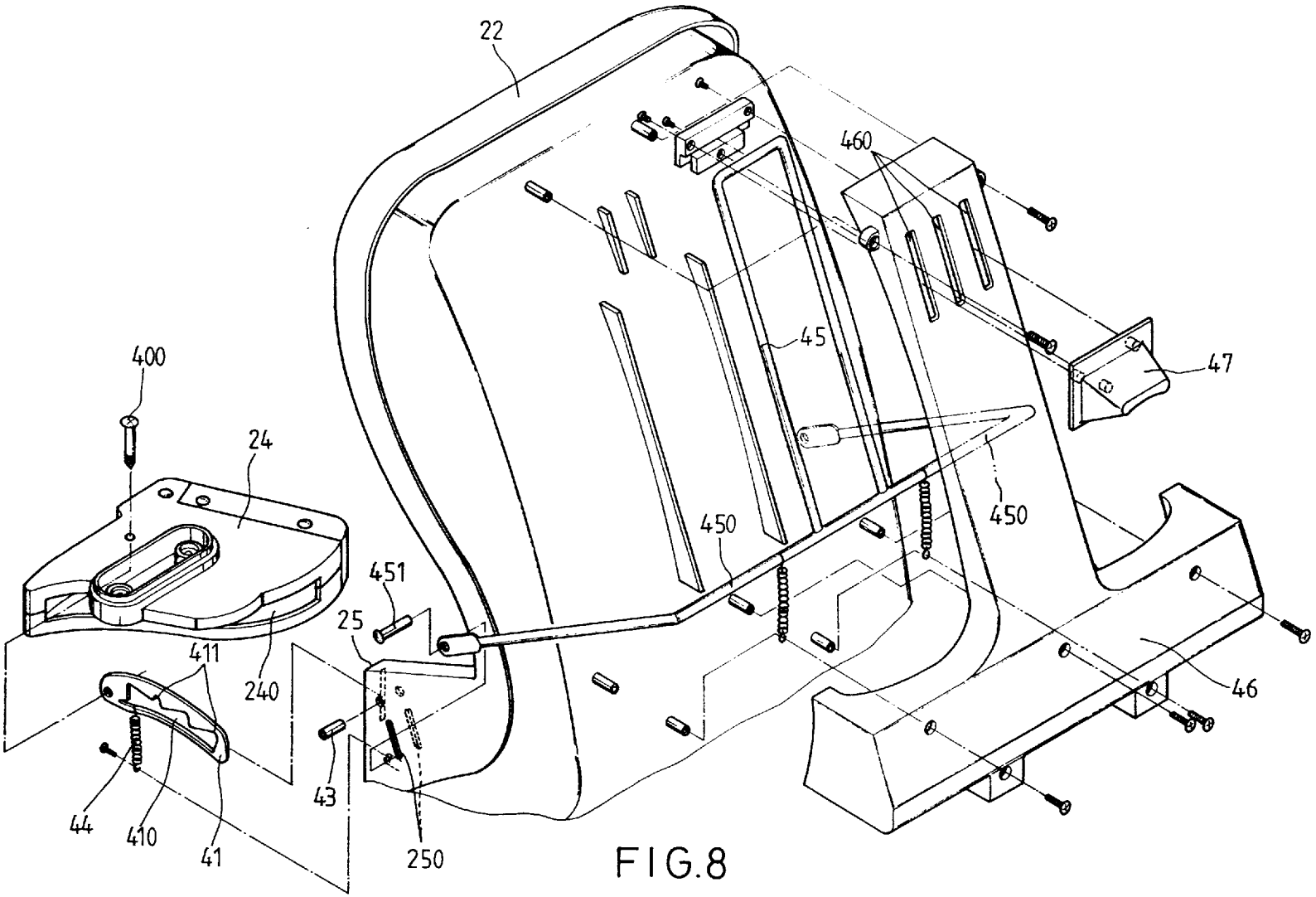
FIG. 8 is an exploded perspective cross-sectional view of an inclining device in the present invention.
Figure 9:
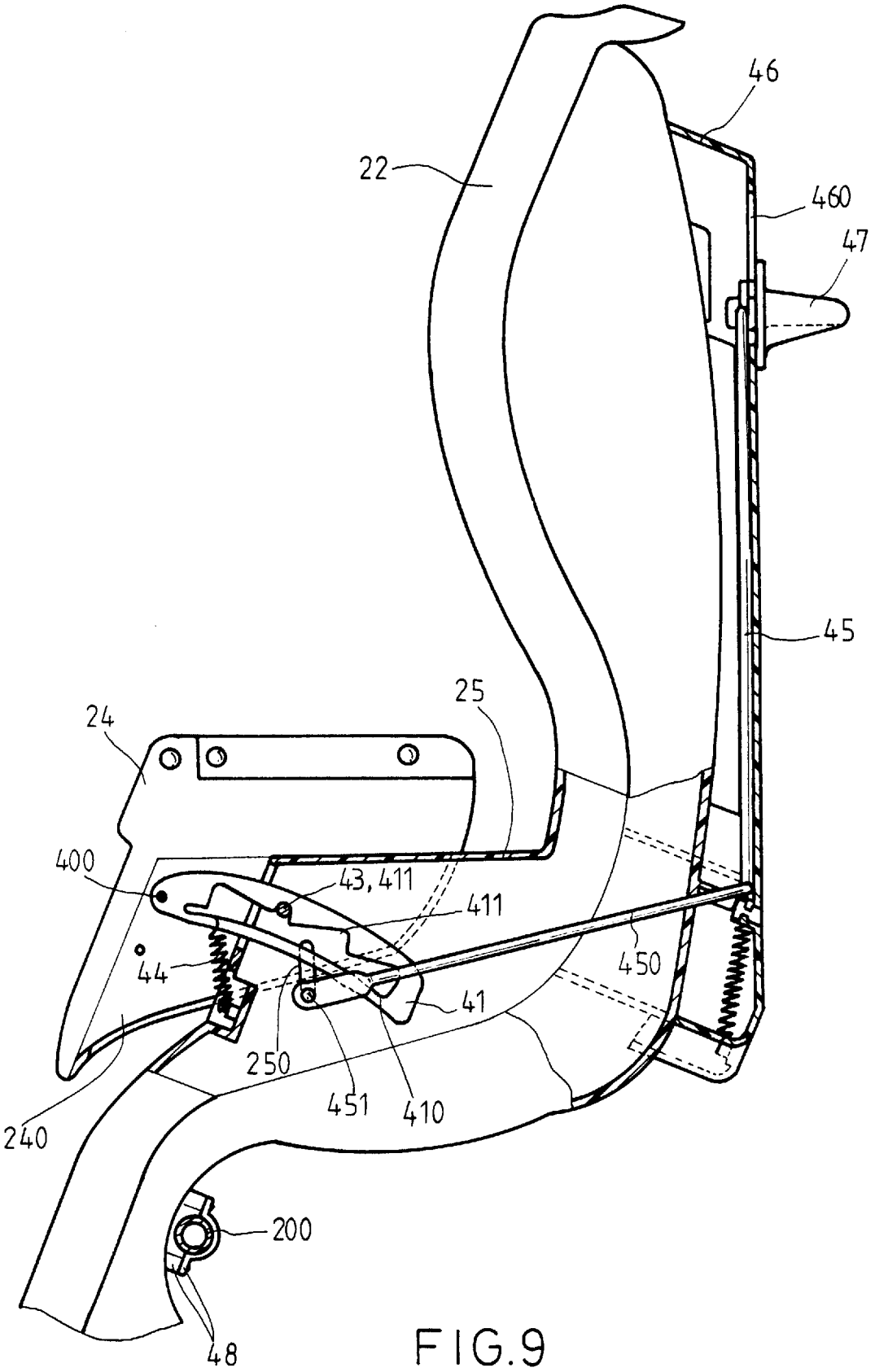
FIG. 9 is cross-sectional view of the inclining device in the present invention.

The inclining device 4 for the seat 22, as shown in FIGS. 3, 8 and 9 is located between the seat 22 and the two arm rests 24, 24 at two sides of the seat 22, fixed on the front support frame 20, including two position plates 41, a spring 44, an activating rod 45, a rod cover 46, a grip 47 and a connecter 48.

The two position plates 41 are inserted in two side hollow walls 25, 25 of the seat 22 from a front side to a rear side, respectively having an intermediate lengthwise aperture 410, a plurality of notches 411 formed irregularly in an upper edge defining the aperture 410 for a pin 43 fitting through the aperture 410 and in a hole in each side wall 25 to engage with one of the notches 410. Further, the front portion of the position plate 41 extends in the chamber 240 of each arm-rest 24, pivotally fixed through the front portion of the chamber 240 with a pivot 400 connecting the front portion of the position plate 41 with each arm-rest 24.

The spring 44 hooks a lower wall defining the slide aperture 410 with one end and fixed with the front section of each side wall 25. Each side wall 25 further has a sloped slot 250 In an Intermediate portion, facing the position plate 41.

Behind the seat 22 is disposed the activating rod 45 consisting of a horizontal movable arm portion 450 and a vertical inverted U-shaped portion fixed on the arm portion portion 450, which has two front ends respectively extending in the chamber 240 of each arm-rest 24 and connected with a screw 451 fitting through and moving up and down in the slot 250. Then the rod cover 46 covers on the activating rod 45, fixed on a rear side of the seat 22, and having a slot 460 for the grip 47 fixed on the cover 46 to fit and move therein so as to move up and down the activating rod 45 for adjusting the angle of the seat 22.

The connecter 48 is provided at a bottom surface of the seat 22, connected with a connect rod 200 of the front support frame 20 so that the seat 22 may be swung back and forth with the connect rod 200 as a shaft.

Figure 10:
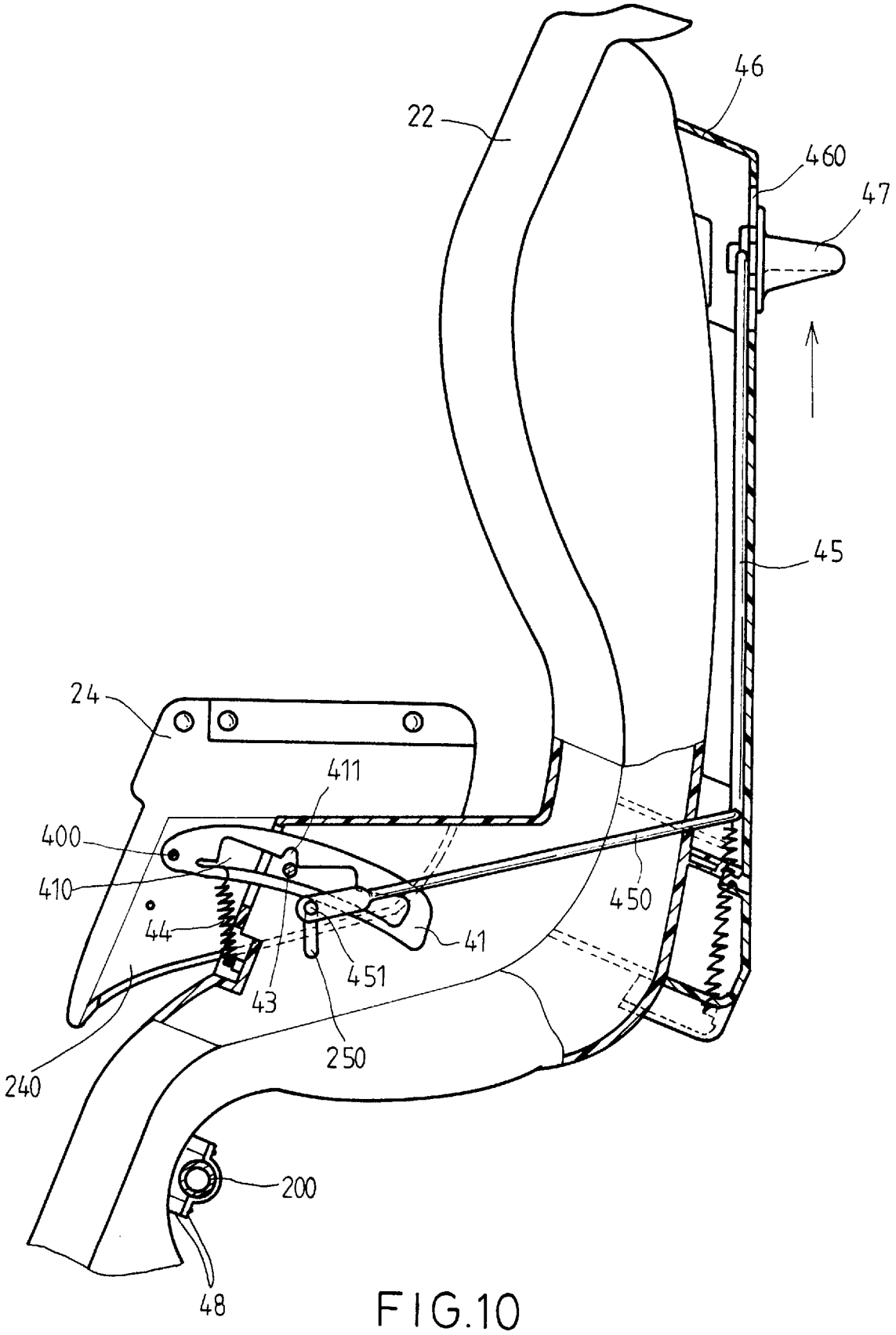
FIG. 10 is a cross-sectional view of the inclining device being operated in one way in the present invention.
Figure 11:
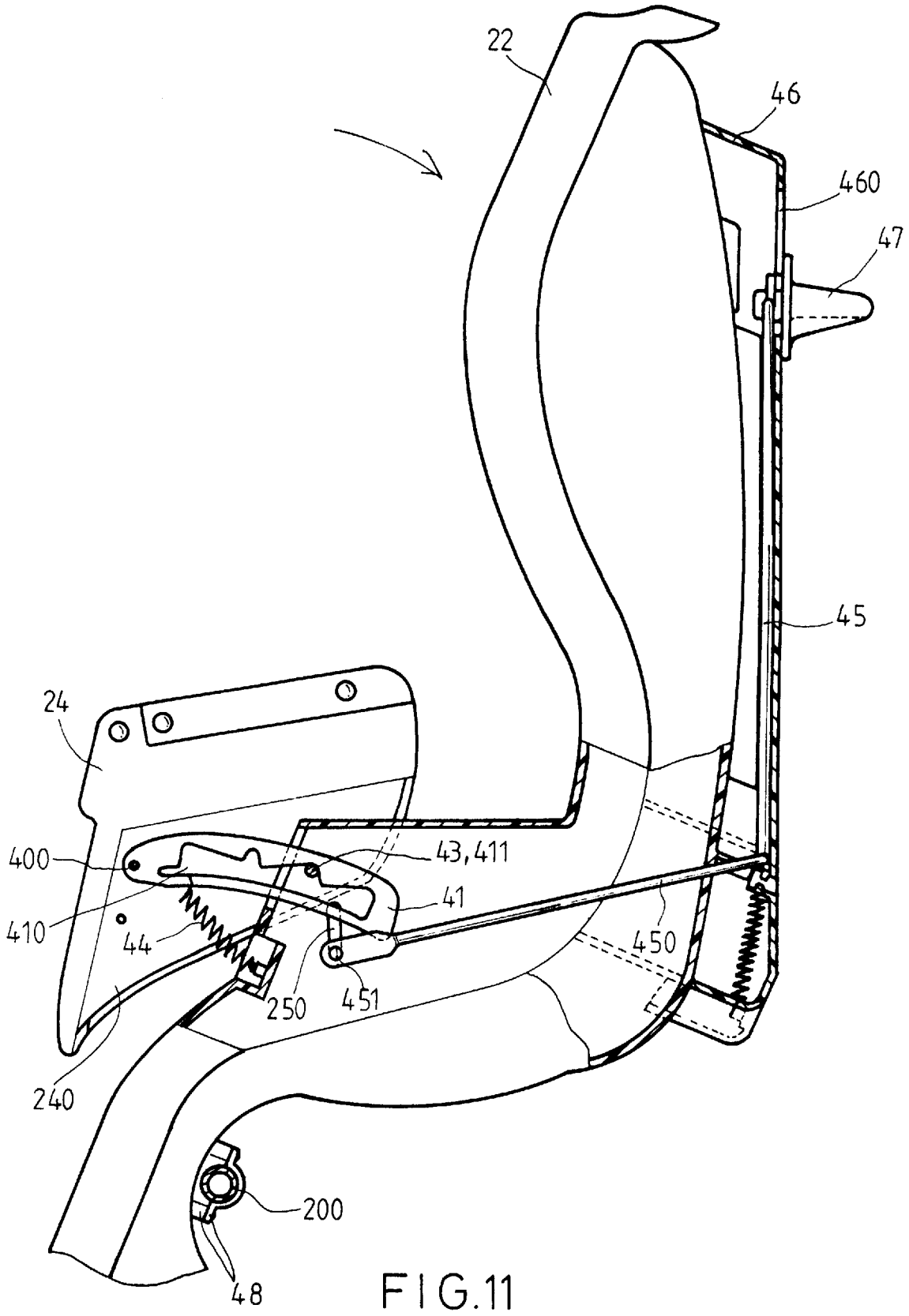
FIG. 11 is a cross-sectional view of the inclining device being operated in another way in the present invention.
Figure 12:
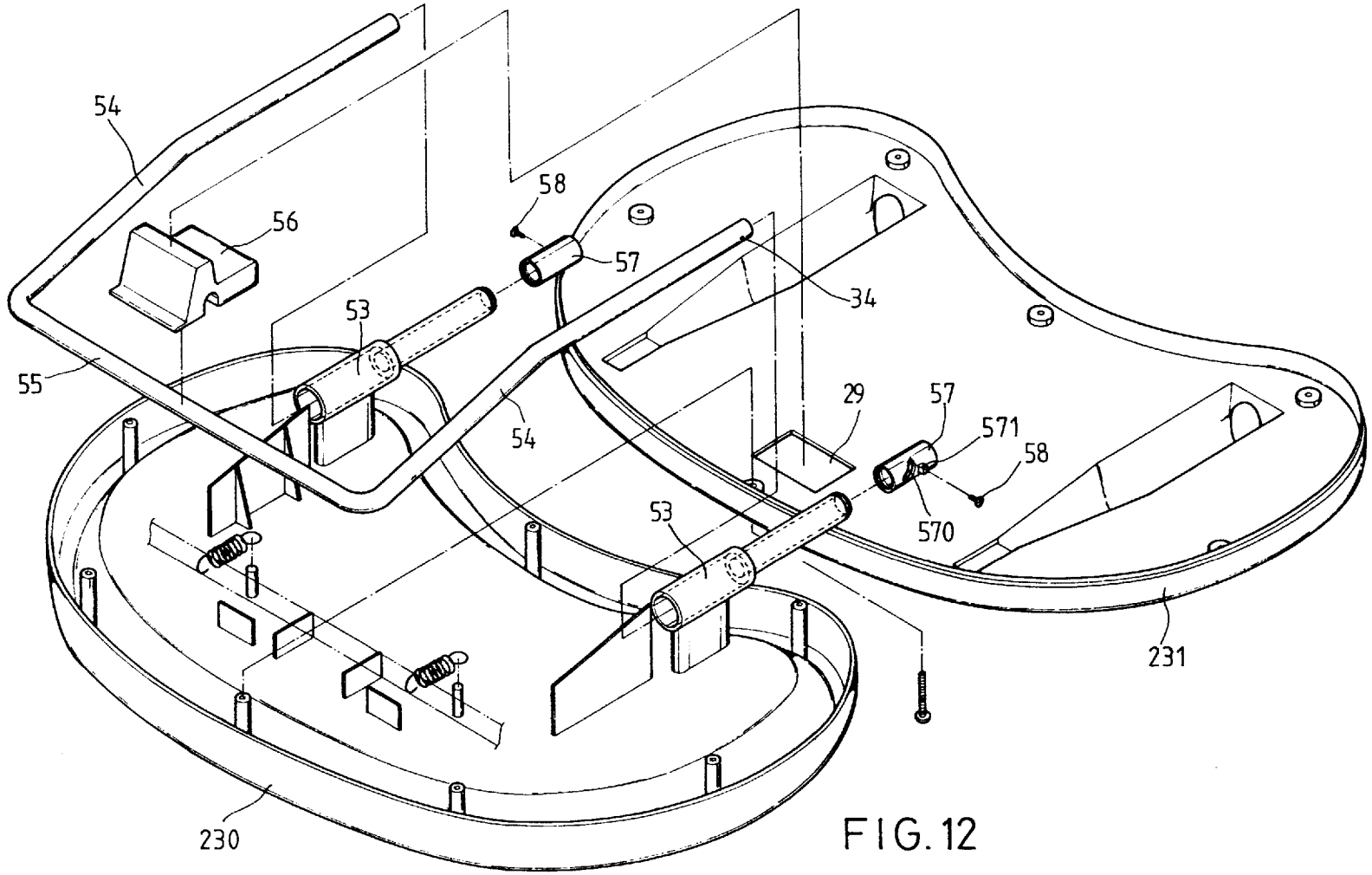
FIG. 12 is an exploded perspective view of a table in the present invention.

Next, FIGS. 9, 10 and 11 show how the inclining device 4 is operated. When the seat 22 is to be adjusted in Its angle, the grip 47 is at first pushed up, moving up the activating rod 45 with the movable arm 450 all together, raising the position plate 41 and letting one of the notches 411 disengage from the rod 43, as shown in FIG. 10. Then the seat 22 is moved to swing back or forth with the connect rod 200 as a shaft. After the seat 22 is adjusted to a needed angle, the activating rod 45 is released by means of the grip 47 pushed down, permitting the spring 44 pull down the position plate 41 and letting the rod 43 engage another of the notches 411 to secure the seat 22 in that position as shown in FIG. 11.

The securing device 5 for the table 23, as shown in FIGS. 12, 13, 14, and 15 includes a plurality of engage members 50, a rotatable member 51, two first sleeves 53, 53, two connect rods 54, 54, a lateral rod 55, two second sleeves 57, 57.

Figure 13:
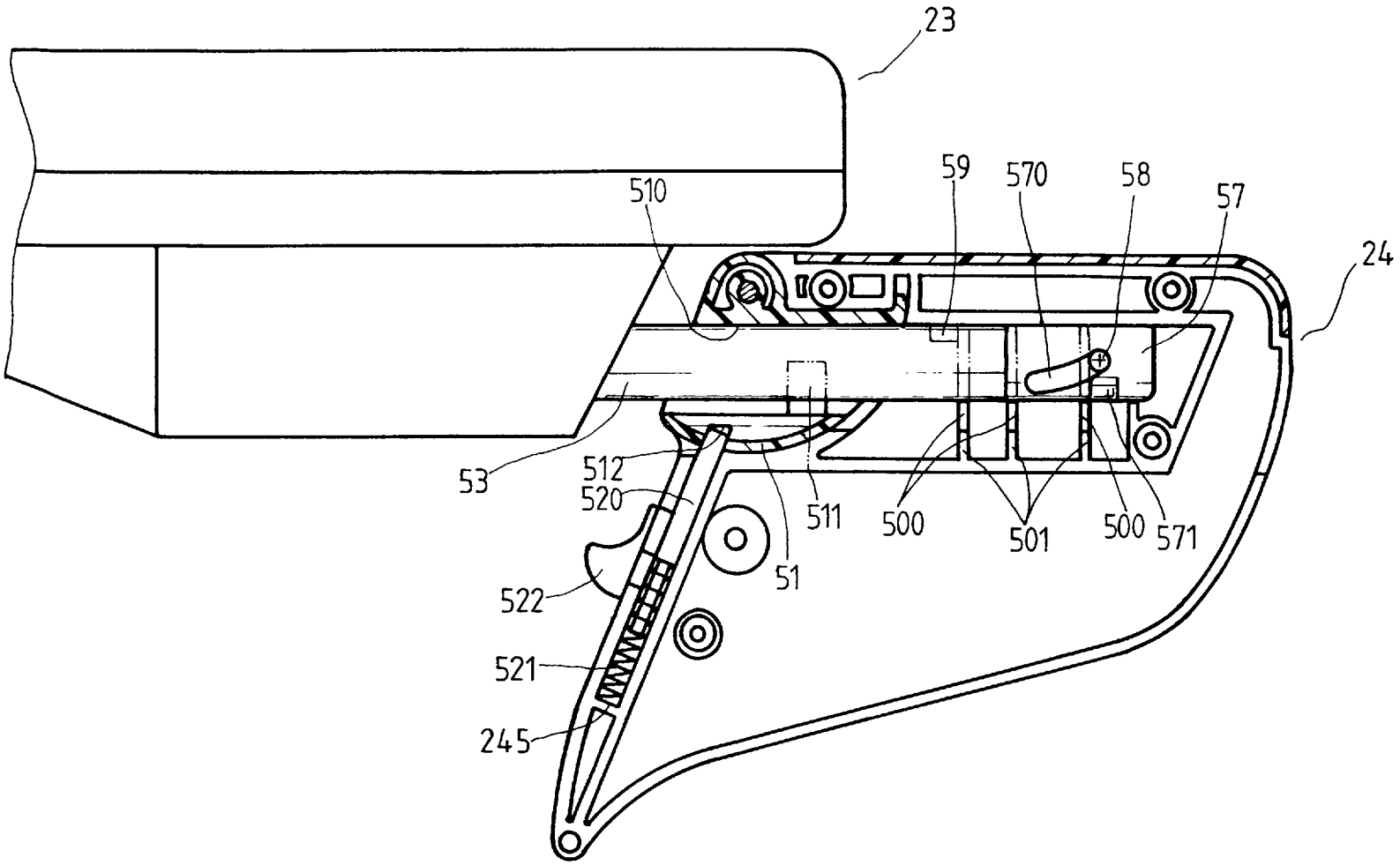
FIG. 13 is a cross-sectional view of the table combined with arm rest in the present invention.
Figure 15:
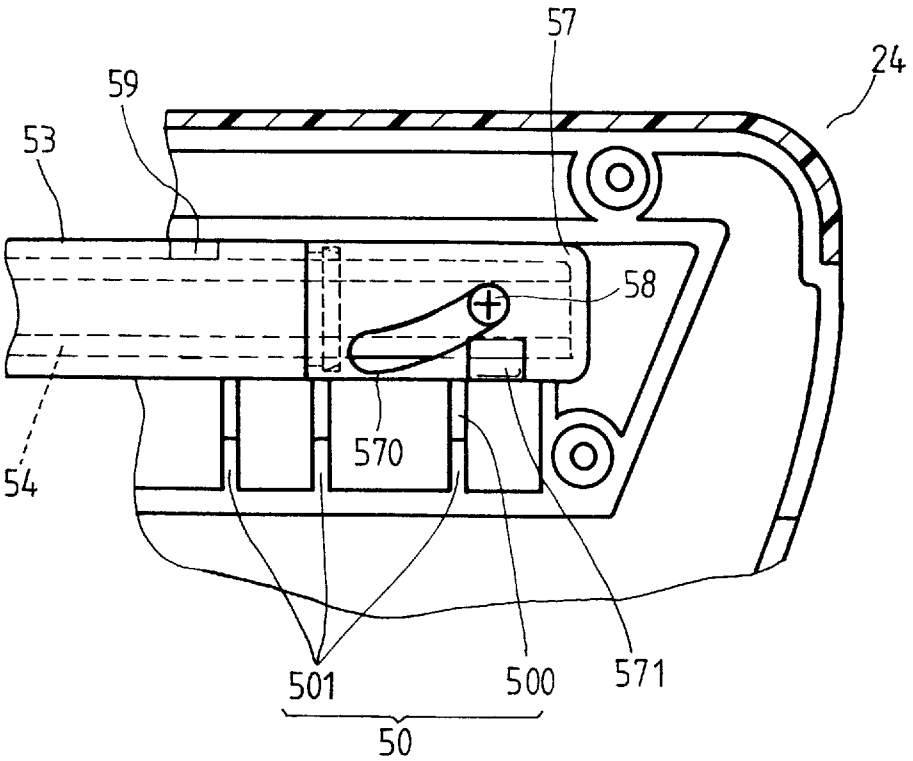
FIG. 15 is another cross-sectional view of the table combined with the arm rest in the present invention.
Figure 14:
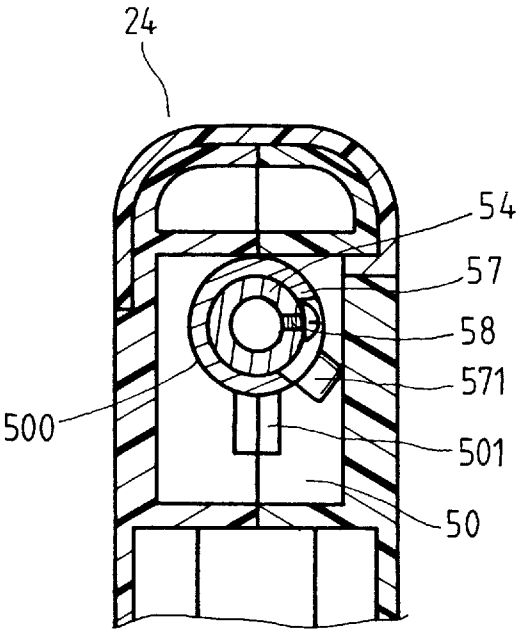
FIG. 14 is another cross-sectional view of the table combined with the arm rest in the present invention.

The engage members 50 are disposed in an inner upper side of each arm-rest 24, a round hole 500 formed in each engage member 50 and a recessed lip 501 formed under and connected with each round hole 500 for each connect rod 54 disposed in the table 23 to fit in, as shown in FIGS. 13, 14.

In front of the engage members 50 is pivotally disposed the rotatable member 51 rotatable upward, having a center passageway 510 for each connect rod 54 to extend in. The wall of the passageway 510 has a recess 511 for a stop key 571 of the connect rod 54 to engage with. In order to limit rotation of the rotatable member 51, a groove 512 is formed in a bottom surface of the rotatable member 51, and a hollow chamber 245 is formed in each arm-rest 24 below the groove 512, with a bar 520 fitting in the chamber 245 and engaging the groove 512. Further, a spring 521 is disposed in the chamber 245 elastically pushing the bar 520 upward to let the bar 520 engage the groove 512. A trigger 522 is fixed with the bar 520, protruding out of the chamber 245 for moving the bar 520 up and down so as to engage or disengage the bar 520 from the groove 512.

The two first sleeves 53, 53 are fixed on an inner surface of an upper plate 230 of the table 23 consisting of the upper plate 230 and a lower plate 231, facing respectively the two arm-rests 24, 24, having their outer ends fitting through the sleeves 53, 53 and extending out of the lower plate 231. The two connect rods 54, 54 are connected integral with a lateral rod 55 between, which is connected with a grip 56 in such a way that the two connect rods 54, 54 may be moved back and forth by the grip 56. The front portions of the connect rods 54, 54 protruding out of the first sleeves 53, 53 fit in two second sleeves 57, 57, which respectively have an inclined slot 570 and a stop key 571, and are fixed securely with the front portions of the connect rods 54, 54 by means of screws 58, 58.

Figure 17:
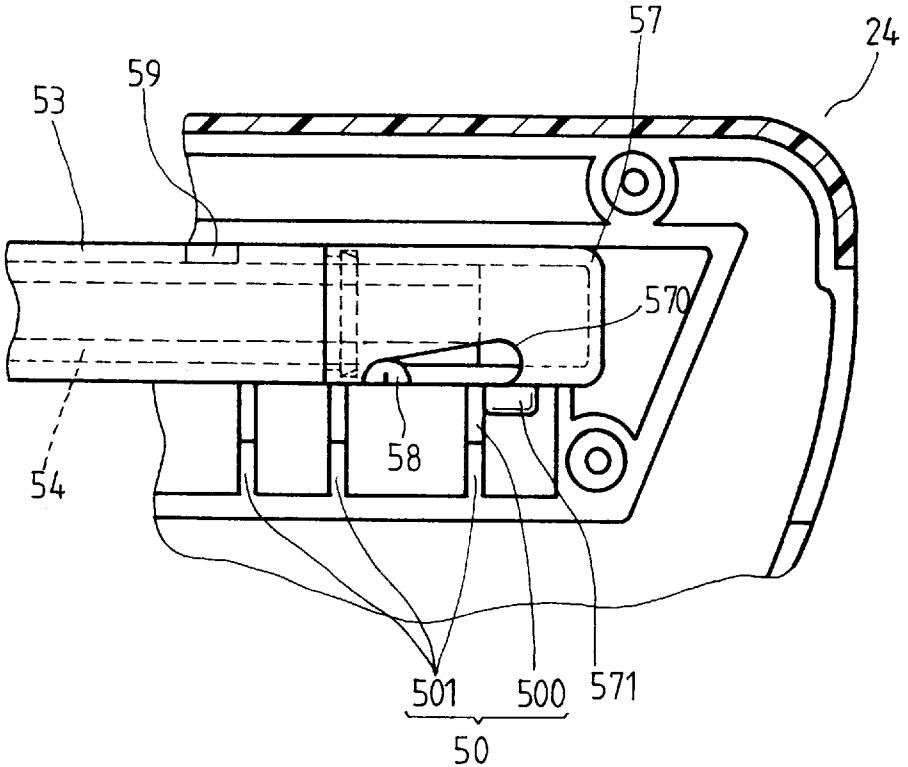
FIG. 17 is another cross-sectional view of the table combine with the arm rest in the present invention.
Figure 16:
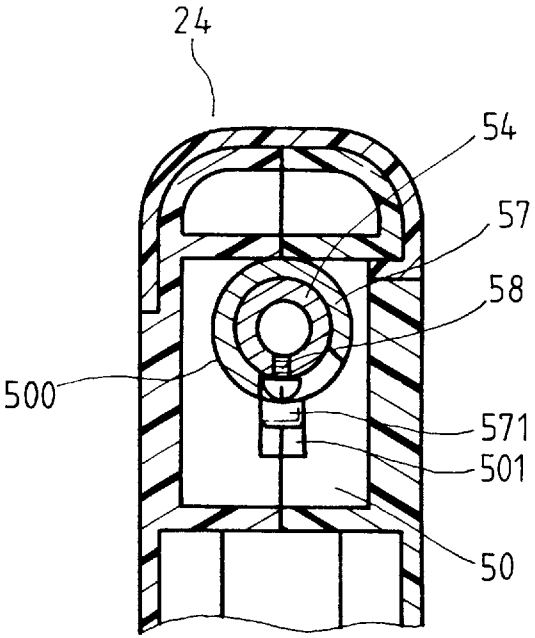
FIG. 16 is another cross-sectional view of the table combined with the arm rest in the present invention.

Next, how to use the nursery chair in the invention is to be described, referring to FIGS. 13–18. At first, the grip 56 is pulled back, forcing the connect rods 54, 54 move back, with the screws 58, 58 sliding along the slots 570, 570, with the second sleeves 57, 57 rotating to move the stop keys 571, 571 down (comparing FIGS. 14, 16) to face the round holes 500, 500 and recessed lips 501, 501, with the sleeves 57, 57 and the connect rods 54, 54 extending in the arm-rests 24, 24 (as shown in FIGS. 16, 17). At this position, the grip 56 is released to let free the connect rods 54, 54, permitting the stop keys 571, 571 return to an original position shown in FIG. 14, engaging the engage members 50, 50. Then the table 23 is locked in that position between the two arm-rests 24, 24, impossible to swing up and down.

Figure 18:
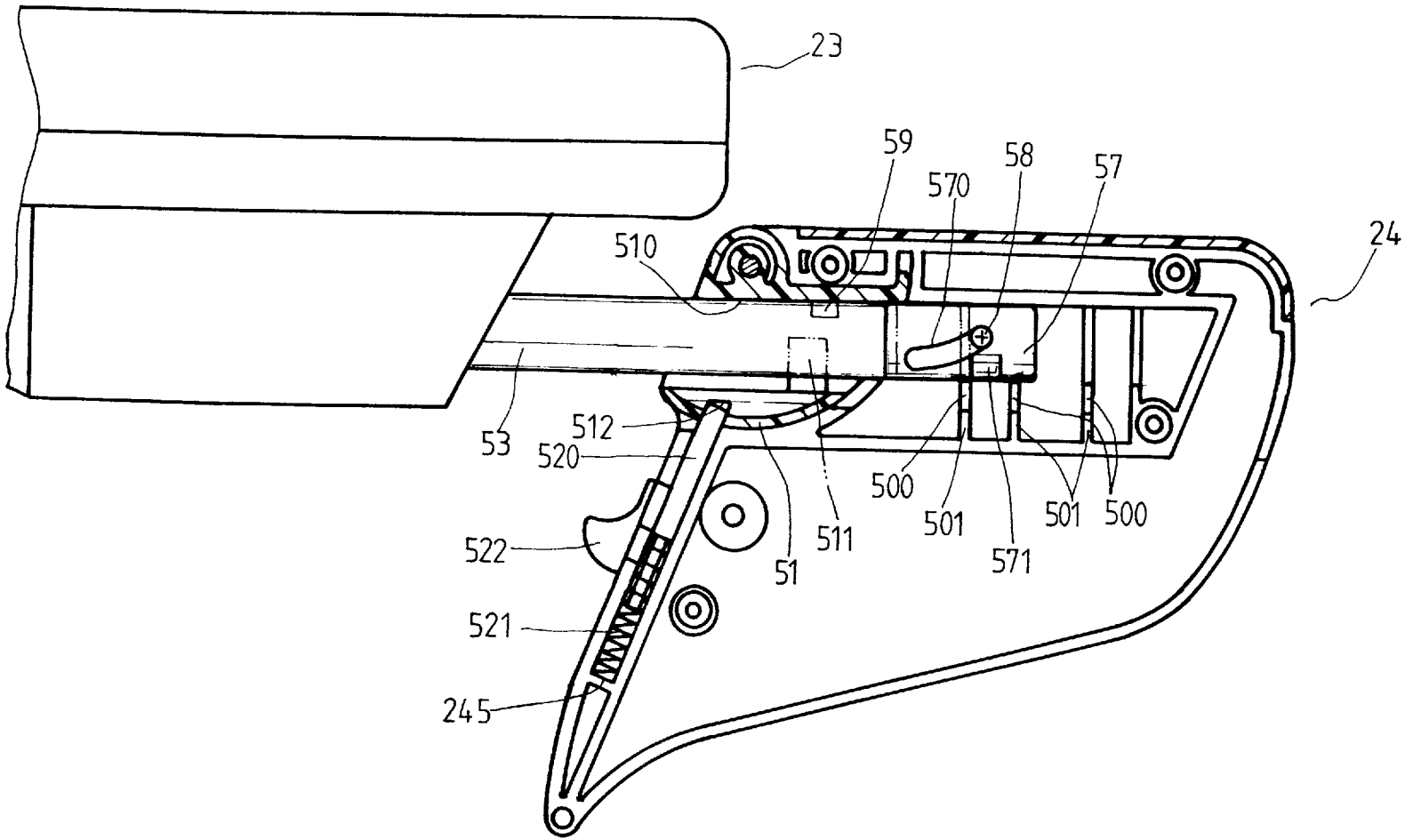
FIG. 18 is another cross-section view of the table combines with the arm rest in the present invention.
Figure 19:
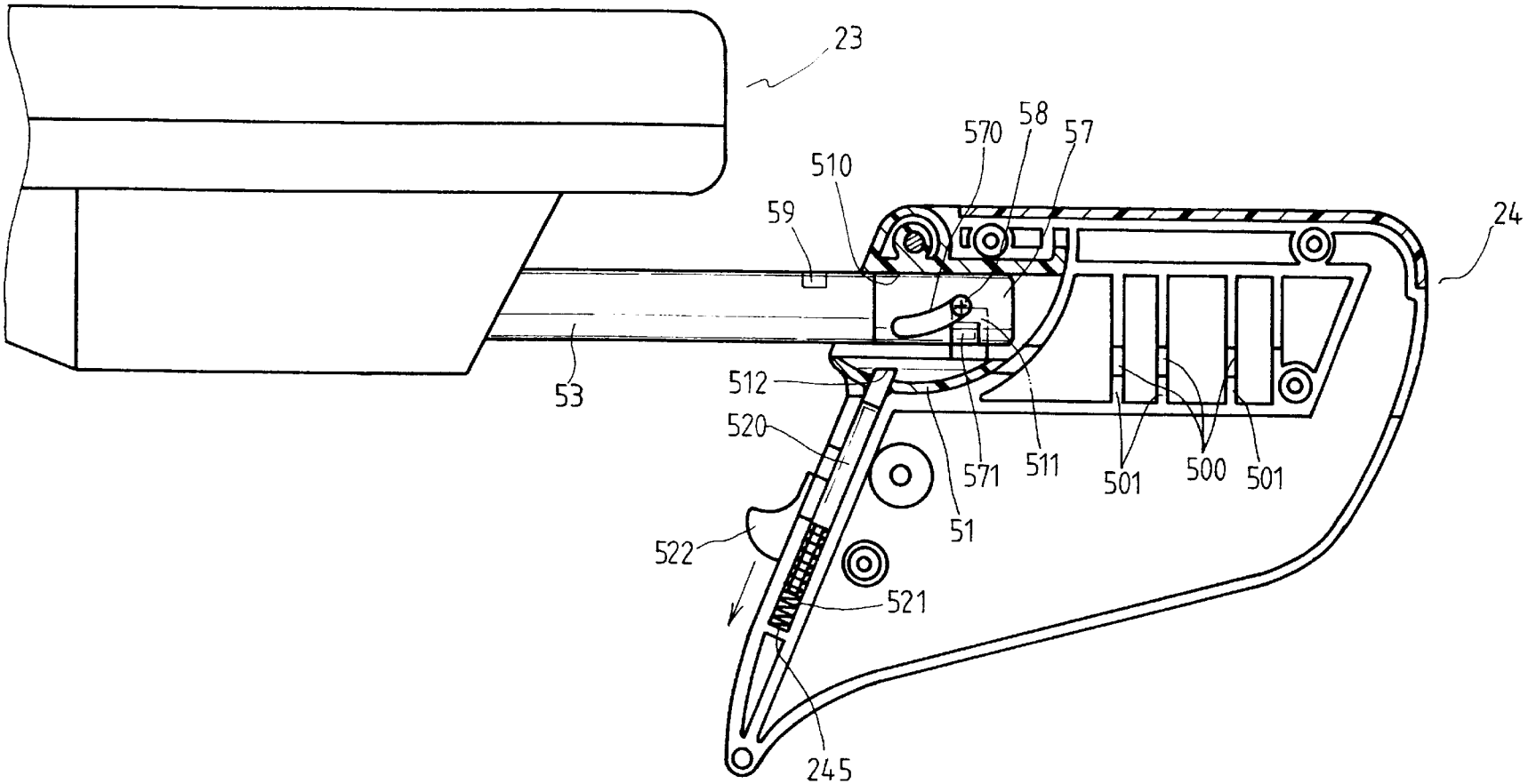
FIG. 19 is a side cross-sectional view of the table being moved in a use position in the preset invention; and, FIG. 20 is another side cross-sectional view of the table being moved in another use position in the present invention.
Figure 20:
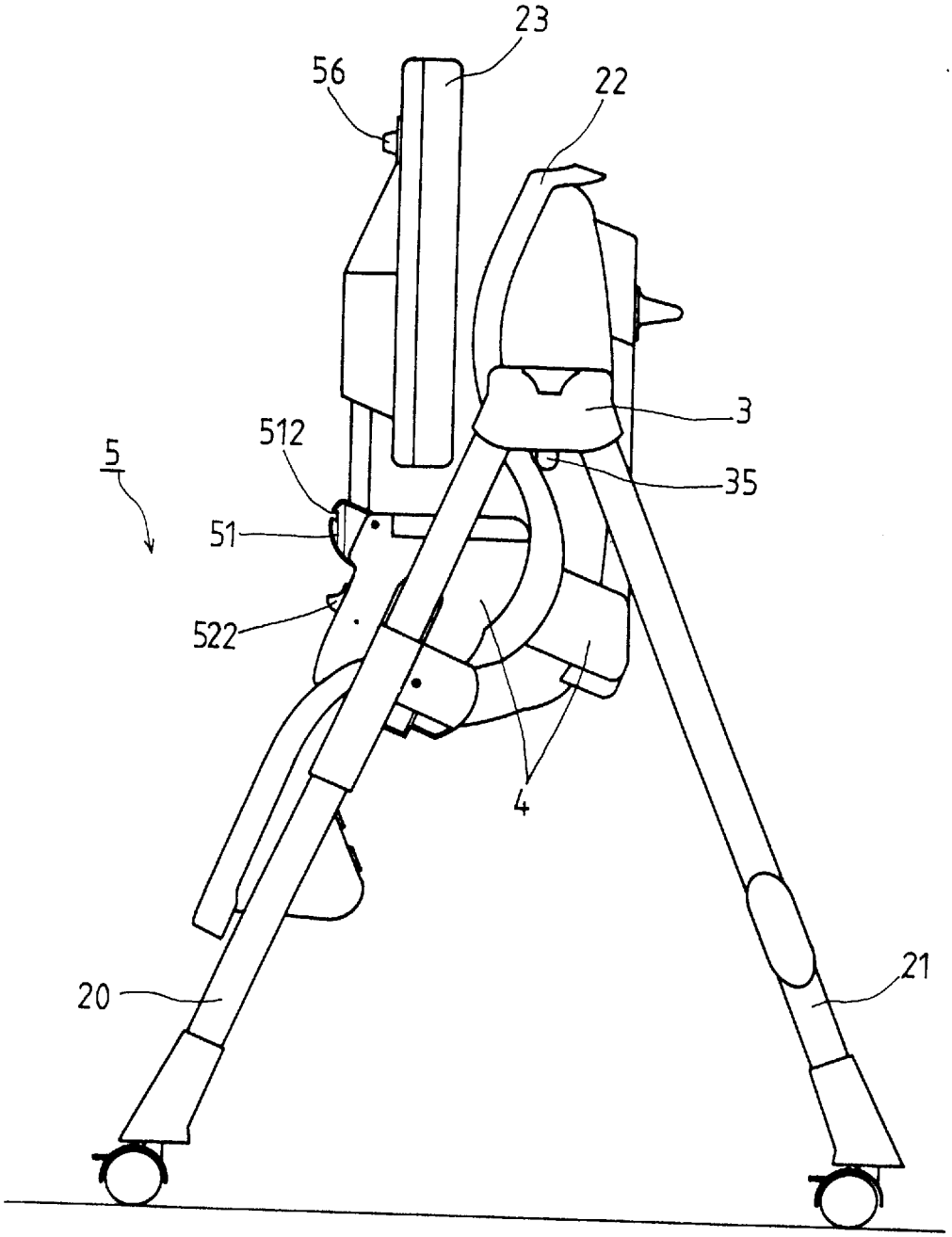

A user can adjust the position of the stop keys 571, 571 to engage one of plural engage members 50 by moving the table 23 back and forth to a needed position (compare FIGS. 13 and 18). Or the table 23 may be completely pulled out of the two arm rests 24, 24. If the table 23 is wanted to be swung up to a vertical position, referring to FIGS. 19, 20, the stop keys 571, 571 is pulled to engage the recesses 511 in the passageways 510 of the rotating members 51. and then the grip 522 is pulled down in the direction shown by the arrow head in FIG. 19, forcing the bar 520 disengage from the groove 512 of the rotating member 51. Then the table 23 can be swung up together with the rotating members 51 to the vertical position shown in FIG. 19. In order to correctly engage the stop keys 571, 571 with the recesses 511, marks 59, 59 may be made on an outer surface of the sleeves 53, 53, when the marks 59, 59 face the front end of the rotating members 51, 51.

Provision of the collapsing device 3 for the front and the rear support frames, the inclining device for the seat and the securing device for table in the present invention offers the following advantages in practical use.

1. The front and the rear support frames can be collapsed to let this nursery chair have a small dimensions, advantageous for storing and transporting, subsequently reducing cost.

2. The seat can be adjusted in its angle so that a user can get a comfortable position to seat on.

3. The table does not swing up and down at random, with its horizontal Position Possible to be moved back and forth, and also removable in case of lifting up a child from the seat. Besides, when the table is wanted to be swung up, the table first has to be pulled to a special position, wherein the stop keys 571, 571 engage the recesses 511 before it is swung up, quite safe to use.

While the preferred embodiment of the invention has been described above, it will be recognized and understood that various modifications may be made therein and the appended claims are intended to cover all such modifications which may fall within the spirit and scope of the invention.

I claim:

1. A nursery chair comprising a front support frame and a rear support frame collapsibly combined with a collapsing device, a seat having two arm-rests at two sides, said two arm-rests are mounted on said front support frame, and said two arm-rests are combined with said seat by means of an inclining device, a table disposed in front of said seat and combined with said seat by means of a securing device, said securing device when engaged prevents said seat from swinging upward inadvertently;

said inclining device comprising;

a chamber formed in a lower portion of each said arm-rest;

a position plate pivotally disposed in said chamber, having an intermediate lengthwise aperture and a plurality of notches formed in an upper wall defining said aperture;

a hollow side wall respectively formed at two sides of said seat, said side wall extends into said chamber of each said arm-rest, said position plate is inserted in said hollow interior from a front side to a rear side, a pin is inserted through said aperture and fixed in each said side wall so as to engage any one of said notches of said position plate for changing a distance between a body of said seat and said arm-rests, and said side wall further includes a slot in a lower portion;

an activating rod located behind said seat and consisting of a vertical inverted U-shaped portion and a horizontal U-shaped connect arm portion formed under said vertical inverted U-shaped portion, two ends of said horizontal U-shaped connect arm portion pivotally connected with said slots of said side wall by means of a pin and able to move up and down so as to move said position plate up and down synchronously;

a rod cover covering an outside of said activating rod, a grip movably disposed on an outer surface of said rod cover and fixed with said activating rod so as to move said activating rod up and down together with said connect arm portion;

a connect rod pivotally connected with a bottom of said seat, said connect rod has two ends connected fixedly with said front support frame, permitting said seat to rotate with said connect rod as a shaft so that said seat may be adjusted to one of many angles.

2. The nursery chair as claimed in claim 1, wherein a spring is further provided between said position plate and each said side wall, said spring elastically pulling down said position plate so that said pin may engage or disengage from one of said notches of said position plate with accuracy and tightness.

3. The nursery chair as claimed in claim 1, wherein said connect rod is combined with the bottom of said seat by means of a tubular means so as to permit said seat to rotate with said connect rod as a shaft.

4. The nursery chair as claimed in claim 1, wherein said activating rod cover has long slots to receive screws of said grip, said screws move within said slots to allow said grip to move up and down.

5. The nursery chair as claimed in claim 1, wherein said collapsing device for said front and said rear support frame comprises:

a connect base having a front room and a rear room for said front support frame and said rear support frame respectively to fit into and to be fixed therein with screws, an intermediate room between said front and said rear support frame, two horizontal slots spaced apart in a lower portion of said connect base for two latch rods to pass through, said latch rods also pass through said front and said rear support frame so that said front and said rear support frame may spread and collapse by means of said slots, said intermediate room having a vertical slot;

a movable plate disposed outside of said connect base, said movable plate includes a notch at two ends for each said latch rod to engage so as to limit the scope of spreading and collapsing of said front and said rear support frame;

a slidable member located in said intermediate room, said slidable member is kept in place by means of a screw passing therethrough, said movable plate and said slot of said intermediate room allowing said movable plate to move up and down so that said latch rods may engage and disengage from said notches for said front and said rear to spread and collapse.

6. The nursery chair as claimed in claim 5, wherein a spring is further provided between said slidable member and said intermediate room of said connect base to ensure said movable plate moves down and engages said latch rods.

7. The nursery chair as claimed as claimed as claim 5, wherein said movable plate has two vertical slots spaced apart, said connect base has two projections on an outer surface, and said two projections fit into and move within said vertical slots so that said movable plate may move up and down along said slots, movement of said movable plate not being biased to the right or the left.

8. The nursery chair as claimed in claim 1, wherein said securing device for said table disposed between said two arm-rests and said table comprises;

a plurality of engage members spaced apart in an upper portion of an interior of said each arm-rest, each engage member having a round hole and a recessed lip connecting with said round hole;

said table consisting of an upper plate and a lower plate, two first sleeves being provided on an inner surface of said upper plate and facing said two arm-rests, said two sleeves having outer ends projecting from a bottom of said lower plate, two connect rods connected with a lateral rod and passing through said two first sleeves, said lateral rod connected with a grip protruding from an outer surface of said lower plate, said grip being pulled back and forth to move each said connect rod back and forth at the same time, said two connect rods having outer ends protruding from said first sleeves and fitting in second sleeves, said two second sleeves respectively having a sloped slot and stop key, said second sleeves being fixed respectively with said connect rods by means of a screw passing through said sloped slots so that said second sleeves may move back and forth with said connect rods said stop key moving in a sloping manner to permit said connect rods to extend into said round holes and said recessed lips of said engage members and engage said engage members to secure said table on said arm-rests.

9. The nursery chair as claimed in claim 8, wherein a rotatable member is further provided in front of said engage members of said arm-rests, said rotatable member rotates upward, said rotatable member having a passageway communicating with said round holes and said recessed lips of said engage members for said connect rods to pass through, said passageway having a recess for said stop key of said second sleeves to fit therein so as to secure said second sleeves to said rotatable member to permit said table to swing upward.

10. The nursery chair as claimed in claim 8, wherein a pin is provided under said rotatable member, said pin fits into said rotatable member for limiting rotation of said rotatable member.

* * * * *